United States Patent [19]

Lefebvre et al.

[11] Patent Number: 4,518,036

[45] Date of Patent: May 21, 1985

[54] DEVICE FOR CONTROLLING A SAFETY VALVE DISPOSED BELOW AN ACTIVATION PUMP IN A HYDROCARBON PRODUCTION WELL

[75] Inventors: Herve M. Lefebvre, par Chartres; Paul M. Helderle, Verneuil-l'Etang, both of France

[73] Assignee: Compagnie Francaise des Petroles, Paris, France

[21] Appl. No.: 445,779

[22] Filed: Dec. 1, 1982

[30] Foreign Application Priority Data

Dec. 2, 1981 [FR] France ..... 81 22542

[51] Int. Cl.[3] ..... E21B 34/08; E21B 43/12

[52] U.S. Cl. ..... 166/105; 166/321; 166/332; 166/106

[58] Field of Search ..... 166/105, 319, 332, 334, 166/321, 322, 324; 417/172, 183, 510, 520; 91/402

[56] References Cited

U.S. PATENT DOCUMENTS

| | | | |
|---|---|---|---|
| 1,062,749 | 5/1913 | Townsend | 91/402 X |
| 1,493,267 | 1/1923 | Kauffman | 417/520 X |
| 1,674,815 | 6/1928 | Barnhart | 166/68 |
| 2,971,581 | 2/1961 | Reglin | 166/334 X |
| 3,040,811 | 6/1962 | Pistole et al. | 166/72 |
| 3,045,760 | 7/1962 | Moore, Jr. | 166/324 |
| 3,092,135 | 6/1963 | Brown et al. | 166/321 |
| 3,614,984 | 10/1971 | Schexnaider | 166/334 |
| 3,799,204 | 3/1974 | Watkins et al. | 166/322 |
| 4,009,756 | 3/1977 | Zehren | 166/68 |
| 4,134,454 | 1/1979 | Taylor | 166/234 |
| 4,293,283 | 10/1981 | Roeder | 417/172 |
| 4,474,234 | 10/1984 | Lefebvre et al. | 166/105 |

FOREIGN PATENT DOCUMENTS

| | | | |
|---|---|---|---|
| 387341 | of 1933 | United Kingdom | 417/520 |

*Primary Examiner*—Stephen J. Novosad
*Assistant Examiner*—Bruce M. Kisliuk
*Attorney, Agent, or Firm*—Sughrue, Mion, Zinn, Macpeak and Seas

[57] ABSTRACT

In a hydrocarbon production well in which the effluent is activated by an activation pump installed in a production pipe, a safety valve is disposed in the production pipe below the pump, the safety valve being operated by lowering of an operating member by a controlling device. The controlling device comprises a piston and cylinder system, and connection means connecting the piston to the operating member during the downward movement of the piston. The cylinder and piston system is provided at the level of the pump, and is advantageously constituted by the production pipe and pump respectively, so that pressurized fluid present at the level of the pump will cause downward movement of the piston.

6 Claims, 11 Drawing Figures

DEVICE FOR CONTROLLING A SAFETY VALVE DISPOSED BELOW AN ACTIVATION PUMP IN A HYDROCARBON PRODUCTION WELL

BACKGROUND OF THE INVENTION

The invention relates to a hydrocarbon production well in which the effluent is activated by an activation pump installed in a production pipe, and in which a safety valve disposed below this pump ensures security in the event of the eruption of the well.

It is important that the pump and safety valve should not be in unit with the production pipe and should be able to be withdrawn independently of this pipe. The pump and the valve must then form a removable unit independent of the production pipe or be installed separately in the latter. In the last-mentioned case, security at the well bottom is retained after removal of the pump, and the safety valve is advantageously installed in such a manner that it can be withdrawn by a simple cable operation.

In addition, control lines for a safety valve which are disposed outside the production pipe are inconvenient to handle and risk being damaged. It would therefore be of interest to be able to control a removable safety valve, which is disposed below an activation pump in a production pipe, without any connection disposed outside the production pipe.

SUMMARY OF THE INVENTION

One aim of the invention is to solve this problem in a simple manner by using, as fluid controlling the safety valve, the pump driving fluid if the pump is of the hydraulic type, or the fluid produced at the outlet of the pump.

According to the present invention there is provided a device for controlling a safety valve which is disposed below an activation pump installed in a production pipe, the safety valve being operated for opening purposes by the lowering of at least one operating member, said device comprising at least one piston and cylinder system in which said piston is displaceable downwardly by pressurised fluid, and connection means providing a connection between said piston and said operating member to effect driving of said operating member when said piston is displaced in said downward direction, wherein said piston and cylinder system is disposed at the level of said pump such that pressurised fluid present at the level of the pump can directly push said piston of said system downwardly.

By use of the invention the installation of special piping for supplying fluid for controlling the opening of the safety valve to the piston and cylinder system can be avoided.

If the activation pump is driven by a driving fluid arriving in the production pipe, the casing of the activation pump may be mounted in the production pipe in such a manner as to be displaceable therein in the vertical direction, said piston then being fixed to said casing and said cylinder to the production pipe. In one such embodiment of the invention the piston is formed by the pump casing and the cylinder by the production pipe, in which the pump casing is slideable on sealing packing means. Advantageously, the pump casing has a first cross-section subject to the fluid pressure prevailing above the casing which is larger than a second cross-section subject to the fluid pressure prevailing below the casing.

The connection means may be mechanical and may comprise at least one rigid, elongate member interposed between the piston and the operating member, being simply suspended on the said piston. If the pump casing itself forms the piston, a tubular member is advantageously fixed at the bottom of the pump casing to form this mechanical connection.

BRIEF DESCRIPTION OF THE DRAWINGS

Embodiments of the invention will now be described by way of example only, with reference to the accompanying drawings.

In the drawings.

DETAILED DESCRIPTION OF THE PREFERRED EMBODIMENTS

Figure 1:
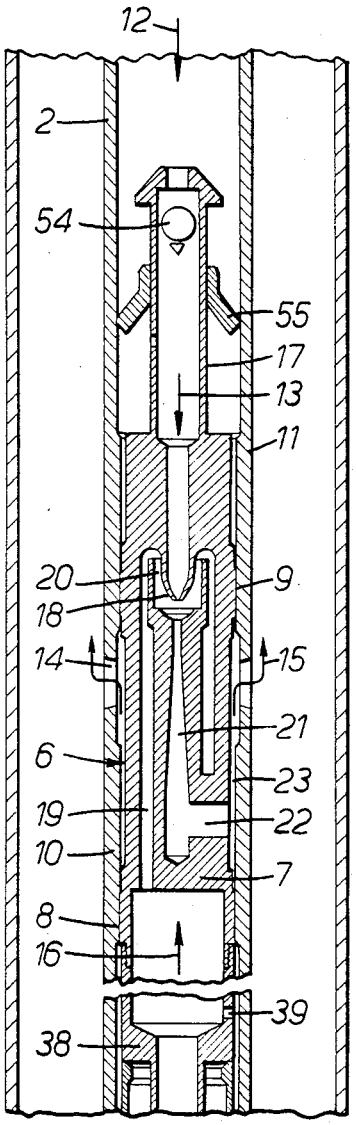
FIGS. 1 and 2 show, in longitudinal section, two portions, succeeding one another in the direction from top to bottom, of the bottom part of a petroleum production well, with an embodiment of a device for controlling a safety valve inside the production pipe.
Figure 2:
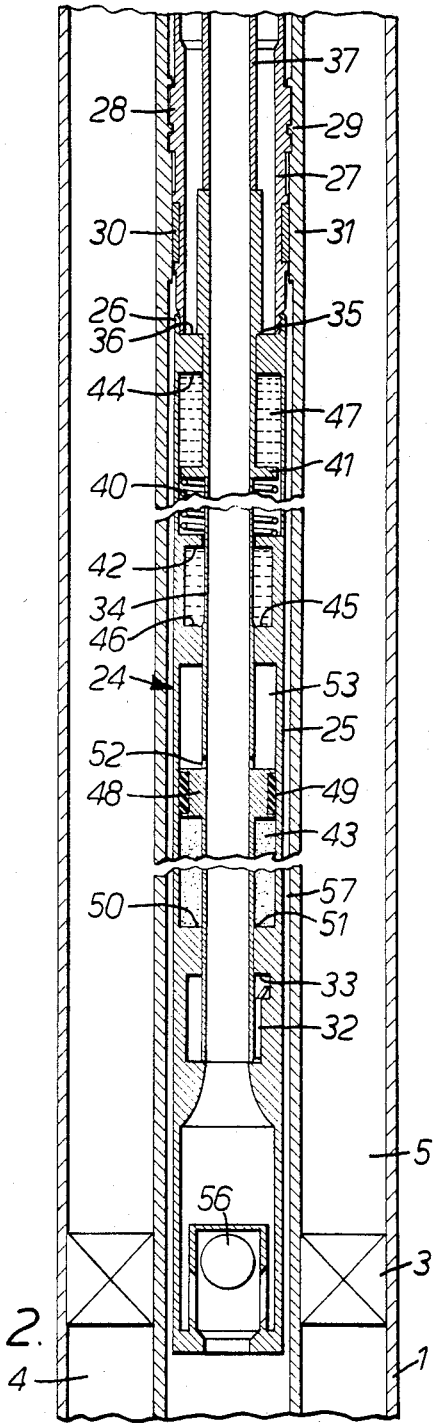

According to FIGS. 1 and 2, the petroleum well comprises a casing 1, inside which a production pipe or tubing 2 is disposed. A sealing device or packer 3 is installed between the tubing 2 and the casing 1 in order to effect the isolation of the annular space portion 4 formed between the production pipe and the casing at the bottom of the well from the annular space portion 5 situated above this packer 3.

An activation pump 6, which is of the hydraulic eductor or ejector type, carries on its casing 7 two sealing packings 8 and 9 which are adapted to slide sealingly inside the tubing 2, on bearing surfaces 10 and 11 provided therein and of sufficient length to ensure that the pump can move between two positions, one corresponding, as will be seen later on, to the opening and the other to the closing of the safety valve.

The driving fluid for the pump 6 passes down from the surface in accordance with the arrow 12, and the pump 6, which is movable in the tubing 2, is pushed down by this driving fluid, the assembly comprising the pump 6 and the tubing 2 forming a piston and cylinder system. Internally, the pump 6 has passages for the driving fluid entering the pump in accordance with the arrow 13 and passing out of the tubing 2 through openings 14 in accordance with the arrows 15, then rising in the annular space 5, and also passages combined with the previously mentioned passages and intended for the effluent which rises from the bottom of the well in accordance with the arrow 16 and passes out of the tubing 2, after mixing with the driving fluid, in accordance with the arrows 15. These fluid passages comprise: a driving fluid inlet pipe 17 followed by an injector 18, a rising vertical effluent inlet passage 19, followed by an annular passage 20 in which the direction of flow of the effluent is reversed and which has its outlet downstream of the injector 18, and an ejector 21. The latter is disposed downstream of the injector 18 and of the effluent inlet facing the injector, and it draws in a mixture of driving fluid and effluent, this mixture constituting the product fluid. This product fluid passes out of the pump 6 through an aperture 22, passes into a space 23 formed between the pump 6, the tubing 2 and the sealing packings 8 and 9, and passes out of the tubing 2 through the apertures 14 in accordance with the arrows 15, then rising in the annular space 5.

Below the pump 6, but independently of the latter, a safety valve 24 is installed in the tubing 2. This safety valve could also be installed below the tubing 2. The body 25 of this safety valve is fastened at the top by a screw coupling 26 to a lock mandrel 27 provided with anchoring means 28 cooperating with an anchoring sleeve or nipple 29 on the tubing 2. The lock mandrel 27 is provided externally with a sealing packing 30 applied against an internal shoulder 31 on the tubing 2.

The body 25 of the safety valve 24 carries a swinging flap 32 which is normally in the raised horizontal position in which it bears against a seat 33 and closes the valve 24. The opening of the valve 24 is effected through the lowering of the flap 32 into the vertical position shown in FIG. 2, this lowering of the flap 32 being caused by the downward movement of an internal sleeve 34 sliding inside the body 25.

The sleeve 34 has been shown in the lowered position, in which it bears, by a step 35, against a shoulder 36 carried by the body 25 of the valve 24. It is brought into this lowered position by a vertical extension tube 37 fixed to the bottom part 38 of the casing 7 of the pump 6 and applied, at its bottom part, against the top end of the sleeve 34. An aperture 39 in the bottom part 38 of the casing 7 permits the displacements of fluid which are caused by the variations of volume of the space formed between the tubing 2 and the assembly comprising the extension tube 37 and the sleeve 34.

If no pressure is applied from above to the casing 7 of the pump 6, the casing 7 is raised in the tubing 2 through the action of a system returning the valve 24 to the closed position. This return system comprises both a spring 40 pushing in the upward direction a piston 41 carried by the sleeve 34, by bearing against an internal shoulder 42 on the body 25, and a precompressed gas chamber 43, for example a nitrogen chamber.

A sealing packing 44 carried by the shoulder 36 and a sealing packing 45 carried by another shoulder 46 on the body 25 form between the sleeve 34 and the body 25 a chamber 47 filled with oil and containing the spring 40, the piston 41 and the shoulder 42, while a calibrated passage is provided between the piston 41 and the body 25 to form a shock absorber which retards the displacement of the piston 41 and consequently of the sleeve 34.

The pressurised gas chamber 43 is formed between the sleeve 34, the body 25, a piston 48 carried by the sleeve 34 and provided with a sealing packing 49, and a shoulder 50 carried by the body 25 and provided with a sealing packing 51. Above the piston 48, apertures 52 pass through the sleeve 34 in order to permit displacements of fluid corresponding to the variations of volume of the space 53 lying between the piston 48 and the shoulder 46, and in order to apply above the piston 48 the pressure prevailing inside the sleeve 34.

A check valve 54 and cups 55 have been provided on the tubing 17, and a foot valve 56 has been installed at the bottom of the body 25 in order to enable the pump 6 to be raised to the surface by reversed pumping.

Instead of the compressed gas chamber 43, it would also be possible to provide for the chamber 43 to be in communication, by way of apertures (not shown) provided in the body 25, with the space 57 formed between the body 25 and the tubing 2 below the sealing packing 30, in accordance with the type of safety valve described in French Patent Application No. 8122544.

The spring 40 may optionally be replaced by diaphragm springs.

In the example illustrated, the pump 6 is entirely supported by the sleeve 34. It would also be possible to provide a collar on the casing of the pump 6 and an internal shoulder in the tubing 2 for receiving this collar at the end of the downward movement of the pump. The action of the spring 40 could also optionally be supplemented by the action of another spring inserted between this collar and the corresponding shoulder.

The opening of the flap 32 is facilitated if the volume of fluid trapped between the flap 32 and the foot valve 56 is considerable (for this purpose the foot valve 56 can be placed on the tubing 2 and not on the body 25 if a precompressed gas chamber is provided at 43), and/or if the foot valve 56 is not completely tight. Similarly, it is preferable for the check valve 54 not to be completely tight, so that the upward movement of the sleeve 34 is not hampered.

FIGS. 1 and 2 do not show the pressure equalisation systems which can be used to permit the deanchoring of the safety valve. In addition, the surface systems permitting hydraulic pumping and, optionally, reversed pumping are also not shown. In numerous cases it will moreover be possible to provide at the surface a device providing an adjustable back-pressure in the annular space 5. This device could in particular consists of an adjustable back-pressure check valve.

The procedure for opening the valve and starting pumping may be as follows:

At the surface the adjustable back-pressure in the annular space 5 is set to about the maximum value Pc which the installation can withstand;

At the surface the driving fluid in the production pipe 2 is gently pressurised to the value Pc, thus bringing about the equalisation of the pressures above the pump 6 and below the pump 6, because there is complete communication between the various passages in the pump owing to the fact that the fluid is circulating at a low rate of flow, but the difference in the cross-sections to which this pressure is applied tends to causse the casing 7 of the pump 6 to move downwards in the tubing 2; the same pressure acts above the piston 48, and this results in the downward movement of the casing 7 and of the sleeve 34, the compression of the chamber 43 and of the return spring 40, and the opening of the flap 32;

The injection of the driving fluid into the tubing 2 is started gently, thus permitting the progressive starting of the pump 6 while holding the safety valve 24 open, the risk of the closing of the latter being avoided by the retarding system disposed in the chamber 47;

The pressure in the tubing 2 is increased to the desired value;

The back-pressure in the annular space 5 is reduced until it reaches the flow pressure at the well head.

The closing of the safety valve 24 is effected automatically as soon as the return forces (spring 40 and chamber 43) are freed through the elimination at the surace of the driving fluid pressure. Normally, the pressures above the pump 6 and below the latter tend to be equalised. The return forces must then be capable of raising the assembly comprising the pump 6, the extension tube 37 and the sleeve 34. If, however, this equalisation could not occur, for example because of the clogging of the injector 18, a pressure differential would be applied in the downward direction and the return in the upward direction of the assembly comprising the pump 6, the extension tube 37 and the sleeve 34 would require greater return forces. For this purpose it is possible to install a series of chambers 43 and 53. The various precompressed gas chambers 43, disposed serially, act in parallel and increase the total section acted on by the return pressure.

The extension tube 37 could be partly or entirely replaced by tubular pieces stacked one on the other, in order to reduce the total length of the assembly fastened to the casing 7 of the pump 6. This extension tube could also be eliminated, in which case the sleeve 34 would be extended to the bottom of the pump 6. Inversely, it would be possible to dispense with the sleeve 34 and to extend the extension tube 37 as far as the obturator 32 of the safety valve 24. All the positions of the mechanical connection between the pump 6 and the sleeve 34, intermediate between these two end positions, may be contemplated, but the position shown in FIGS. 1 and 2, corresponding to the level of the lock mandrel 27, makes it possible to have two assemblies, the pump and the valve, quite separate from one another, and it reduces the extension tube 37 to the minimum length compatible with easy deanchoring of the lock mandrel 27.

In the example shown in FIGS. 1 and 2, it has been assumed that the pump was of the jet pump type, but it would be equally possible to use a hydraulic pump in which the driving fluid is separate from the product fluid.

Figure 7:
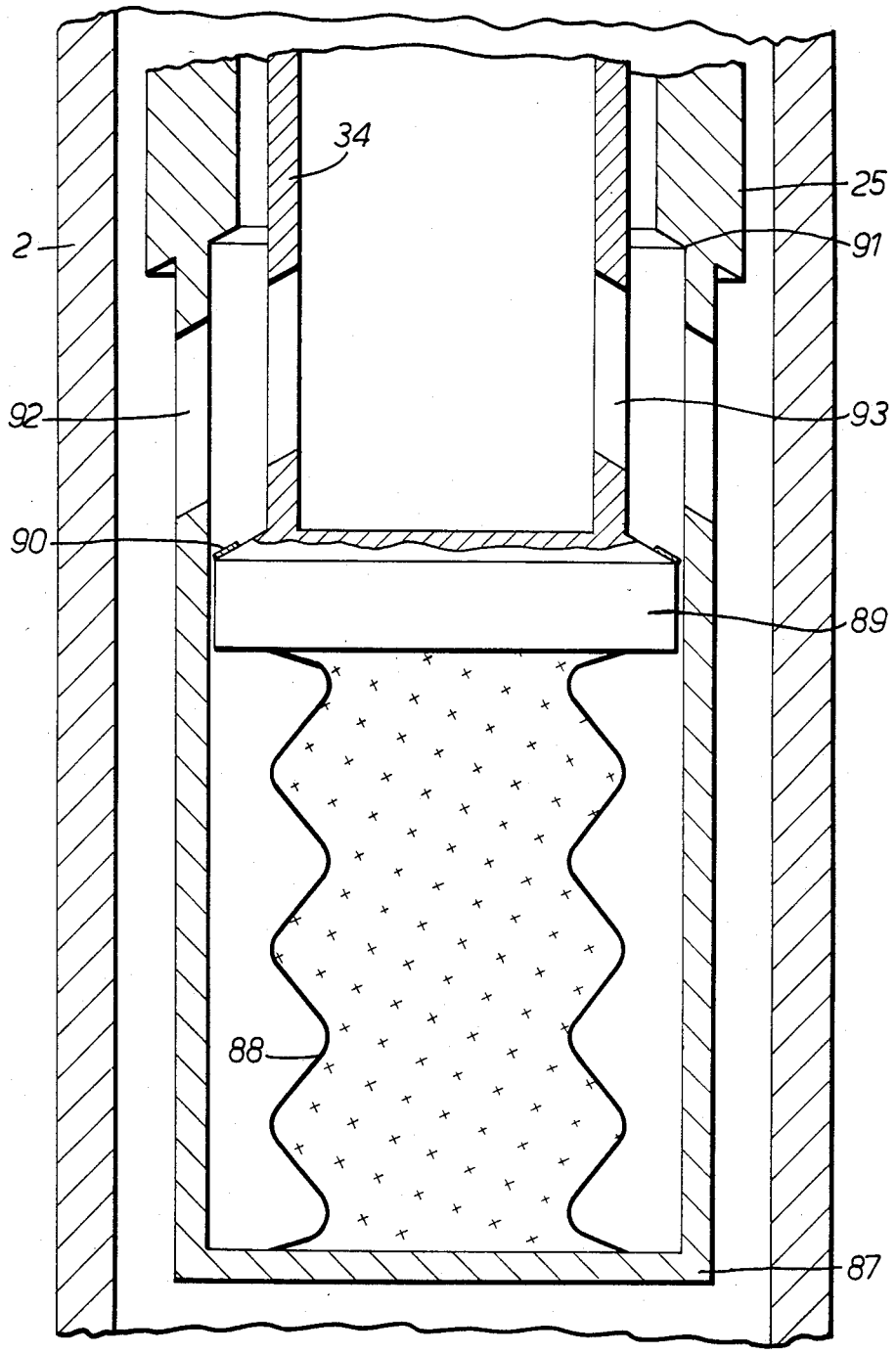
FIG. 7 shows a modification of the valve closure system.

The obturator of the safety valve 24 may obviously be of a different type from the flap 32 (FIG. 7 illustrates one example of this), the only condition for the application of the invention being that the operating member for moving the obturator between its open and closed conditions should be movable upwardly and downwardly.

Figure 3:
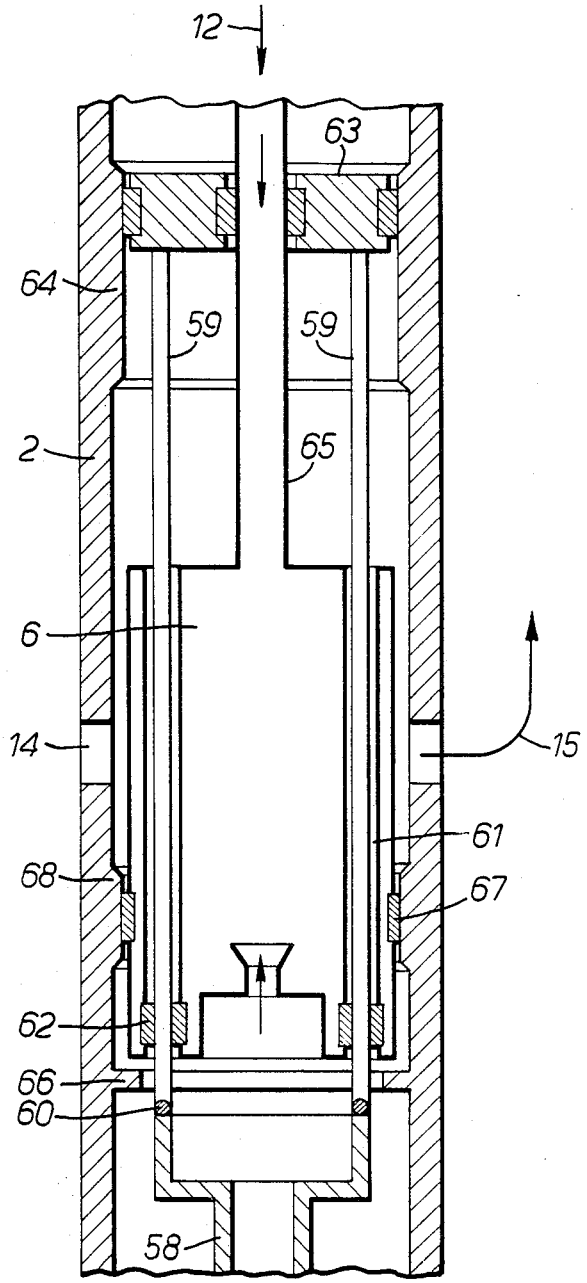
FIG. 3 shows, likewise in longitudinal section, a modification of the control device shown in FIGS. 1 and 2.

In the example shown in FIG. 3, there is illustrated very schematically as assembly comprising an activation pump 6 and the tubing 2 at the level of that pump, above a tubular member 58 serving the same purpose as the extension tube 37 for the operation of a safety valve, which may be the same as that in the example shown in FIGS. 1 and 2.

Rods 59 connected at the bottom, at 60, to the tubular member 58 pass through the pump 6 in passages 61 provided with sealing devices 62, and are connected at the top to a movable piston 63. This piston 63 is adapted to slide sealingly on a bearing surface 64 on the tubing 2 and along a driving fluid inlet duct 65 leading into the pump. The pump 6 is held in the tubing 2 by a stop 66 provided inside the tubing 2. A sealing packing 67 carried by the pump 6 is applied against a shoulder 68 on the tubing 2. The pressure of the driving fluid acts on the top cross-section of the piston 63, while the pressure of the product fluid acts on the bottom cross-section, which is smaller, of the piston 63.

A similar arrangement would make it possible to apply differentially the pressure of the driving fluid and the pressure of the fluid below the pump, or the pressure of the product fluid and the pressure of the fluid below the pump.

Figure 4:
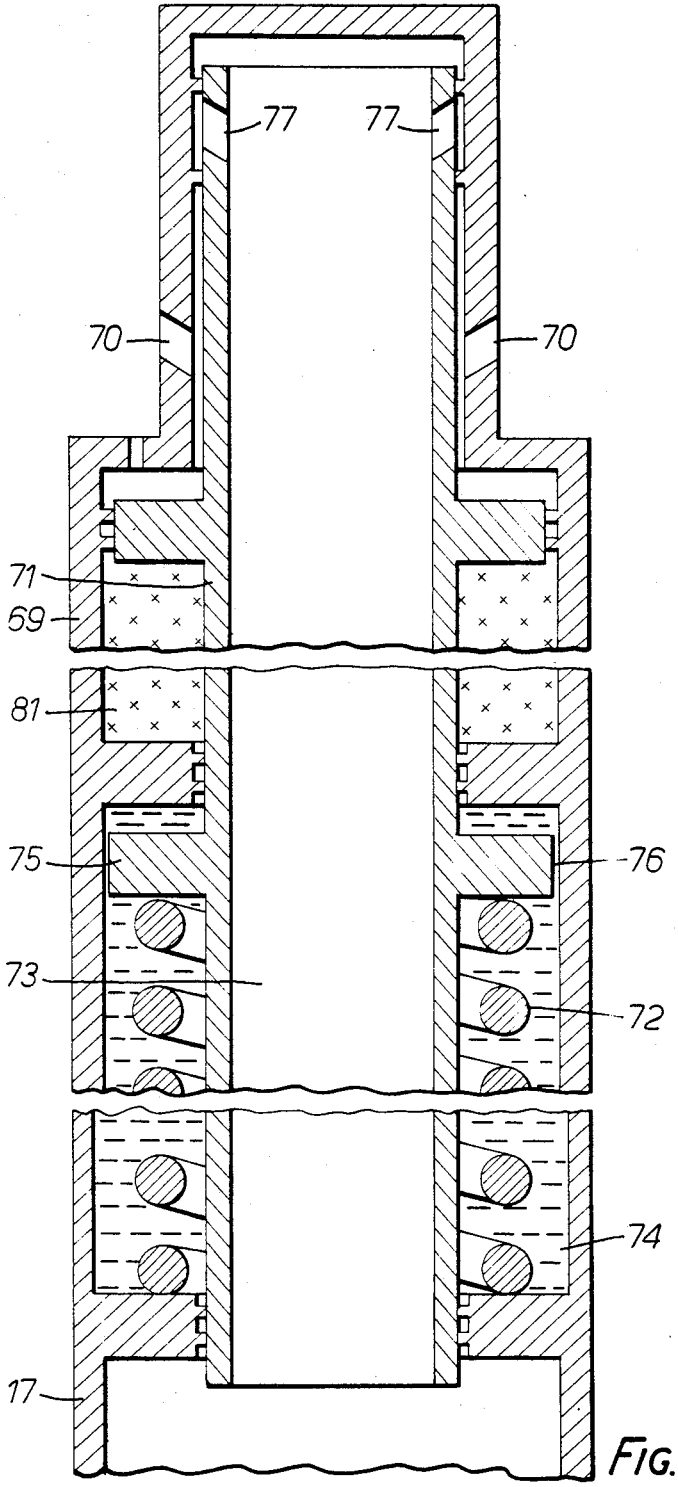
FIGS. 4 and 5 show, in longitudinal section, two modifications of a retarding device disposed at the driving fluid inlet of an activation pump of the hydraulic type.
Figure 5:
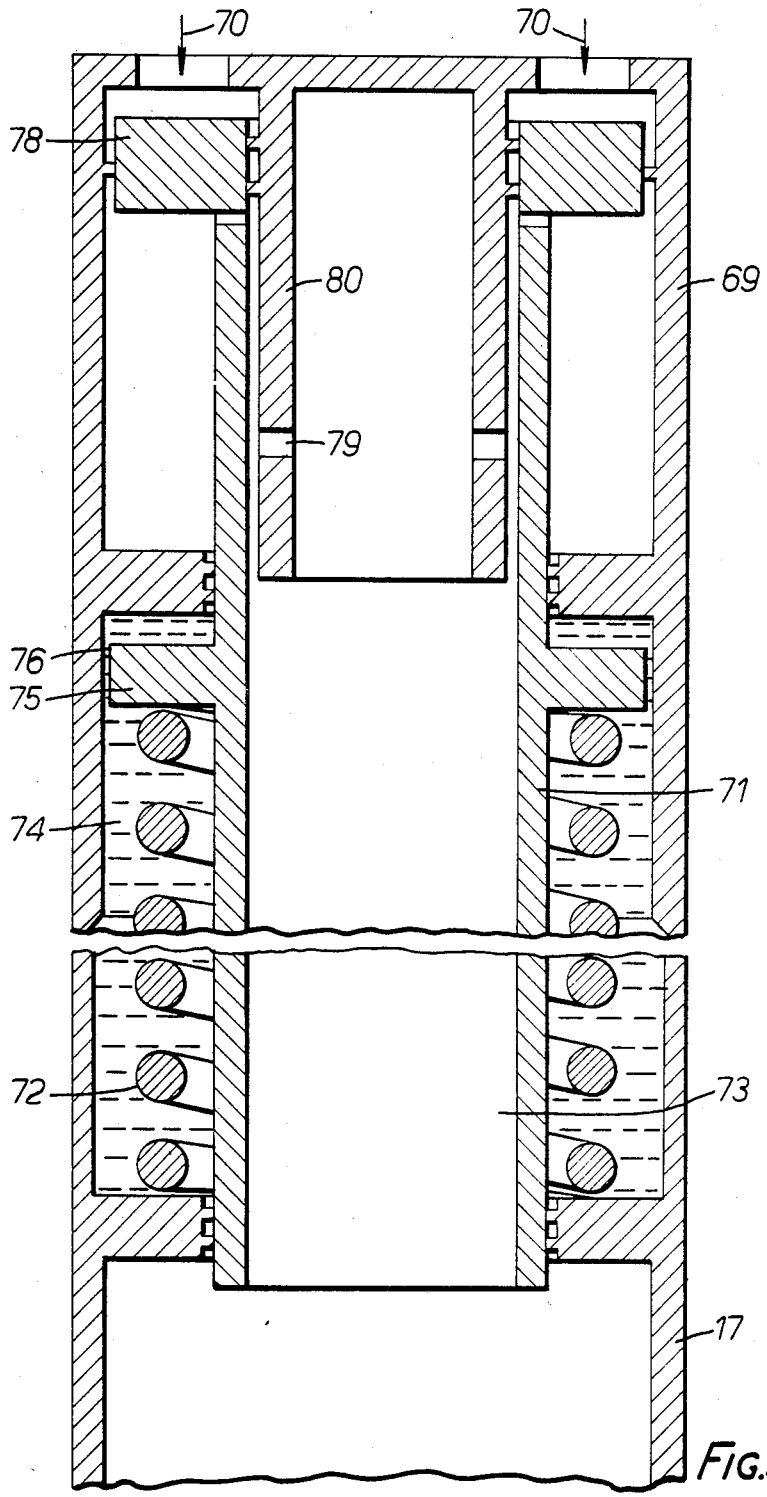

FIGS. 4 and 5 show two modifications of a retarding means which, on starting up, delays the admission of the driving fluid into the pump 6, while this driving fluid acts without delay on the opening operation of the safety valve. This retarding means is mounted at the top of the inlet pipe 17 or 65 and replaces the check valve 54.

In the two modifications, the casing 69 of the retarding means is provided with apertures 70 for the admission of the driving fluid into the retarding means, and a movable assembly 71, urged into the closed position by a spring 72, passes, through the action of the driving fluid penetrating through the apertures 70, into an open position in which the apertures 70 are in communication with an interior space 73 opening into the interior of the inlet pipe 17 or 65. A chamber 74 filled with a viscous oil and containing a piston 75 having a calibrated passage 76 provides the desired retardation of the displacement of the movable assembly 71.

In the case of FIG. 4, the open position is reached when apertures 77 provided in the assembly 71 arrive opposite apertures 70, while in the case of FIG. 5 the open position is reached when a piston 78, originally inserted between the apertures 70 and the apertures 79 provided in a cylinder 80 against which the piston 78 slides, has passed these apertures 79. In the case of FIG. 4, a precompressed gas chamber 81 has been added.

Figure 6:
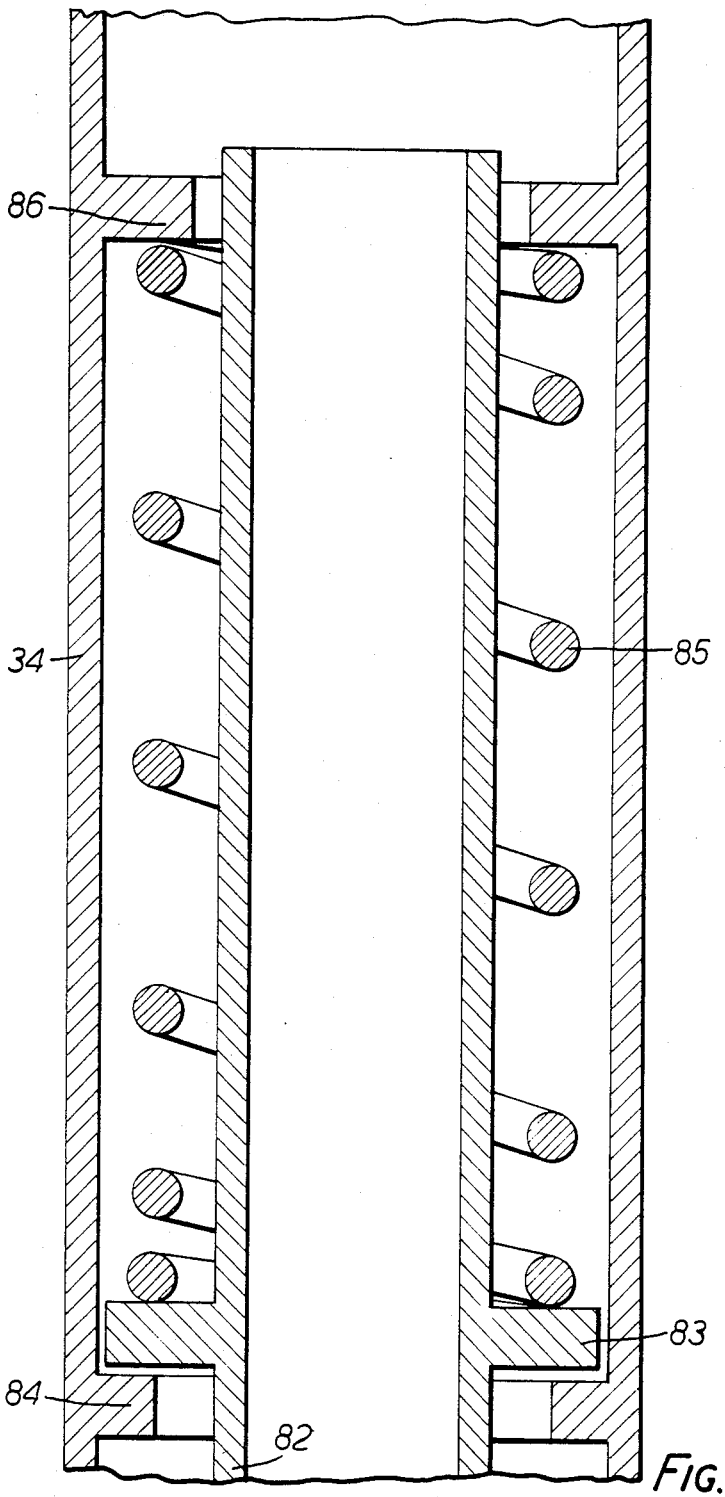
FIG. 6 shows a system reducing the support force on the obturator of the valve.

FIG. 6 shows a device for reducing the support force of the operating member on the obturator of the valve 24. The bottom part of the sleeve 34 is not applied directly against the flap 32. The flap 32 is operated for opening purposes by a member 82, the bottom part of which is not shown and which is carried by the sleeve 34, by means of a stop 83 on the part 82, bearing against a bottom stop 84 on the sleeve 34, and by means of a coil spring 85 held between the stop 83 and a top stop 86 on the sleeve 34. Thus, when the sleeve 34 moves downwards and the member 82 comes to bear against the flap 32, the spring 85 starts to be compressed. When the sleeve 34 rises, the spring starts to be decompressed and then the member 82 is driven by its stop 83 through the action of the stop 84.

The opening phases of the safety valve 24 will now be examined in the case of the example shown in FIGS. 1 and 2 and when use is made of a retarding means of the kind shown in FIGS. 4 and 5 and of a support force reducing device of the kind shown in FIG. 6.

For closing purposes the following operations are carried out:

In the tubing 2 a pressure is applied which is close to the maximum pressure Pc which the casing can withstand, thus bringing about the commencement of the downward movement of the assembly 71 and the downward movement of the casing 7 of the pump 6 and of the internal sleeve 34 of the valve 24, because the pressures above and below the pump 6 cannot be equalised owing to the action of the retarding means. The flap 32 of the valve 24 does not yet open, because of the system shown in FIG. 6.

For a short time a pressure equal to Pc is applied in the annular space 5, thereby equalising the pressures on each side of the flap 32 and opening the latter. The easing of the pressure in the annular space 5 does not entail the reclosing of the flap 32, because the pressure is still applied in the tubing 2 and the retarding means has not yet arrived at the end of its stroke. The situation is then that an eruption is possible through the annular space 5.

When the retarding means has reached the end of its stroke, the pump 6 starts up automatically because of the difference in pressure between the pressure applied to the interior of the tubing 2 and that prevailing in the annular space 5.

The pressure applied in the tubing 2 is progressively increased until it attains the desired value.

The closing of the valve 24 is effected in the same way as was described previously, if the retarding means is designed so that the valve has time to reclose while the retarding means is still in the open position.

FIG. 7 shows the bottom part of a valve which can be used in place of the flap valve 24 shown in FIG. 2. The valve body 25, of generally cylindrical shape like that shown in FIG. 2, is closed at the bottom by a base 87, against which bears a bellows 88 filled with a precompressed gas, for example nitrogen. This bellows supports a closure member 89 fixed to the bottom of the internal sleeve 34. At the top the obturator 89 forms a valve head 90 which, when the internal sleeve 34 is in the raised position, cooperates with a seat 91 provided on the body 25. The body 25 and the sleeve 34 have side openings 92 and 93 respectively, which face one another when the internal sleeve is in the lowered position. This type of valve makes it possible to combine the closure system and the precompressed gas chamber system.

Figure 8:
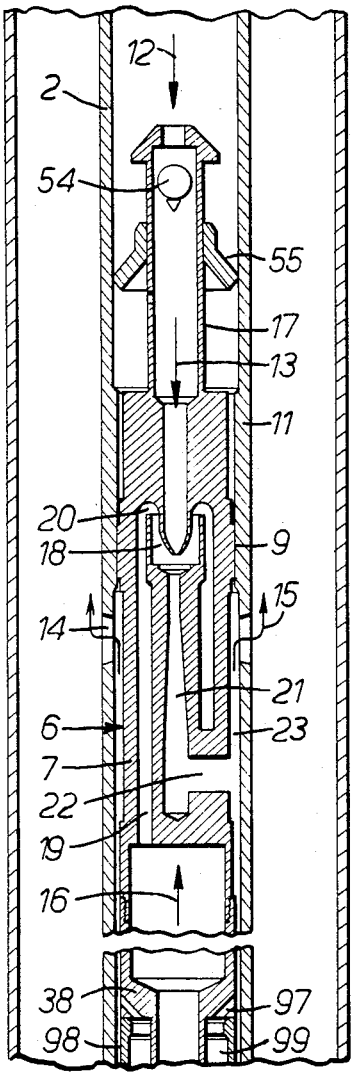
FIGS. 8 and 9 show, in longitudinal section, two portions, succeeding one another from top to bottom, of a petroleum production well, as in FIGS. 1 and 2, but in the case of a modified embodiment, and FIGS. 10 and 11 similarly show a petroleum production well with a different embodiment of the control device.
Figure 9:
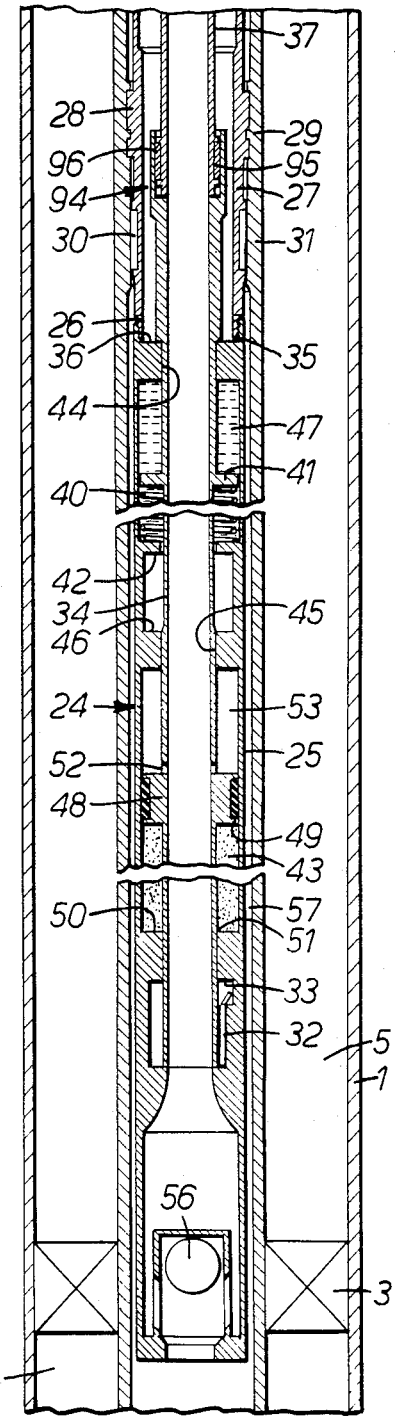

FIGS. 8 and 9 show a modification of the arrangement shown in FIGS. 1 and 2, wherein it has been possible to dispense with the movable sealing packing 8 and the bearing surface 10. In order to do this, the bottom end of the extension tube 37 has been connected to the top end of the internal sleeve 34 by a sealing device 94. This sealing device comprises a sleeve 95 fixed on the internal sleeve 34, extending the latter in the upward direction and surrounding the bottom end of the extension tube 37, and also a sealing packing 96 inserted between the sleeve 95 and the extension tube 37 and carried by one of these last two members. The aperture 39 has obviously been eliminated, and apertures 97 have been provided in the bottom part of the casing 7 in order to connect the space 98, formed between the tubing 2 and the lock mandrel 27, and the space 99 formed between the lock mandrel 27 and the extension tube 37.

In the examples shown in FIGS. 1 and 2 and in FIGS. 8 and 9 it has been assumed that the activation pump slides in the tubing 2. It could also be arranged to slide in a tube extending the body 25 of the valve 24 in the upward direction, in such a manner that the assembly comprising the pump and the valve would form a unit placed in position or withdrawn in a single operation.

Figure 10:
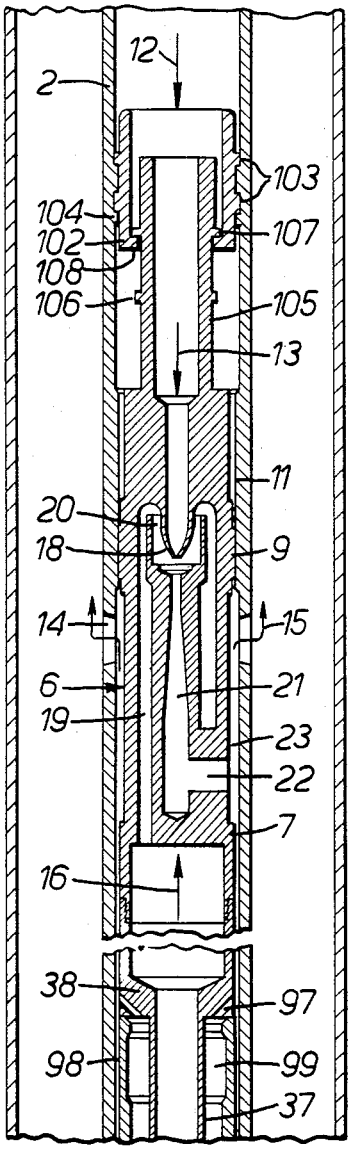
Figure 11:
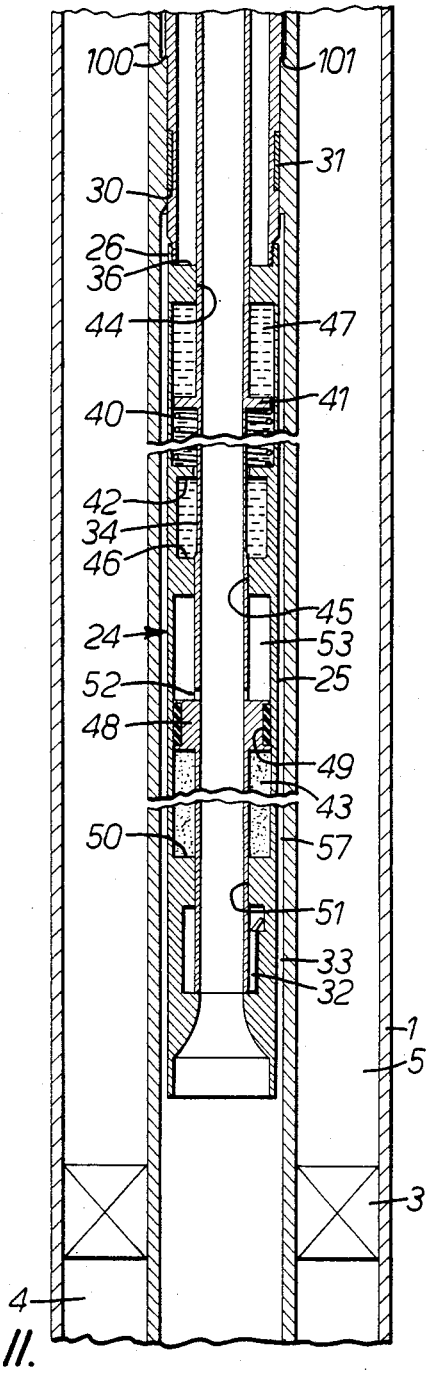

FIGS. 10 and 11 show another way of forming a pump-valve assembly adapted to be placed in position or withdrawn in a single operation. Here, this assembly does not have a casing common to the two members, the pump and the valve, but these two members are attached to one another.

The extension tube 37 and the internal sleeve 34 form a single unit or are members fixed to one another, for example by the butt welding of their ends.

The mandrel 27 is not locked by anchoring means in the tubing 2, but is only retained in the downward direction by a shoulder 100 on the mandrel, this shoulder being applied against a matching shoulder 101 on the tubing 2.

As in the example shown in FIGS. 8 and 9, the sealing packing 8 and the bearing 10 have also been dispensed with and the aperture 39 has been replaced by apertures 97. Here, however, the casing 7 is attached at the top to a lock mandrel 102 provided with anchoring means 103 cooperating with an anchoring sleeve 104 on the tubing. The casing 7 is attached to the lock mandrel 102 by means of a tubular member 105 fastened to the casing 7 and adapted to be displaced vertically inside the lock mandrel 102. The assembly comprising the casing 7 and the tubular member 105 is provided with stops 106 and 107, which cooperate with a stop 108 carried by the mandrel 102 in order to determine a vertical displacement path for the casing 7 in the tubing 2, while effecting a limitation of the downward displacement of the pump 6 and the retention of the latter in its upward movement, this retention ensuring the holding of the safety valve 24 in the event of an eruption.

The installation of the tubular member 105 does not pose any problems, because the pipe 17, the check valve 54 and the cups 55 have become unnecessary and the withdrawal of the pump has to be effected with the aid of a cable and not be reversed pumping. The foot valve 56 has likewise been eliminated, the chamber 43 being a chamber filled with precompressed gas.

All the examples described above are obviously not of an exhaustive nature. They are given only in order to illustrate the number and the variety of the embodiments which can be adopted in the application of the invention.

What is claimed is:

1. An oil well installation including an elongate cylindrical casing (1), an elongate cylindrical production pipe (2) concentrically disposed within the casing and inwardly spaced therefrom, and annular packer means (3) sealingly disposed between the casing and the pipe to isolate annular spaces both above (5) and below (4) the packer means, comprising:

(a) a pump (6) disposed within the pipe above the packer means, said pump being driven by pressurized liquid applied to the pipe from above to pump oil from below the pump upwardly through the annular space above the packer means, (b) a safety valve (24) disposed within the pipe below the pump and including biasing means for normally closing said valve to seal off the pipe and thereby guard against pressure eruptions from below, (c) a rigid, elongate, vertically movable operating member (34) slidably disposed within the valve and operable, when driven downwardly, to open the valve against the force of the biasing means, (d) means (40, 43) for urging the operating member in an upwardly direction, (e) piston means slidably disposed within the pipe at the level of the pump and movable downwardly in response to the application of pressurized pump driving liquid to said pipe, and (f) rigid elongate connection means (37) secured to the piston means and depending downwardly therefrom for operatively engaging the operating member, whereby the downward movement of the piston means in response to the application of pressurized pump driving liquid to the pipe serves to drive the operating member downwardly within the safety valve to open said valve and enable pumping, and the cessation of said pressurized driving fluid enables the urging means to raise the operating member, the connection means and the piston means to thereby automatically close the safety valve.

2. An installation according to claim 1, wherein said pump is axially displaceable within said pipe, and said piston means comprises a casing of said pump.

3. An installation according to claim 2, wherein said pump casing has a first, upper cross-section which is subject to the pressure of liquid above said casing, and a second, lower cross-section which is subject to the pressure of liquid below said casing, said upper cross-section being larger than said lower cross-section.

4. An installation according to claim 2, wherein said connection means comprises a tubular member fixed to the bottom of said pump casing.

5. An installation according to claim 2, wherein said pump is a hydraulic pump, and retarding means is installed at a driving fluid inlet of the pump.

6. An installation according to claim 4, wherein said safety valve is mounted within the pipe by fastening means at an upper end thereof, and a lower end of said tubular member is situated at the level of said fastening means.

* * * * *